US007617650B1

(12) United States Patent
Hansen et al.

(10) Patent No.: US 7,617,650 B1
(45) Date of Patent: Nov. 17, 2009

(54) FASCIA-MOUNTED ALUMINUM RAILING SYSTEM

(76) Inventors: Tracy C. Hansen, 4860 Shute Rd., Hillsboro, OR (US) 97124; Lucas Anthony Gregg, P.O. Box 332, North Plains, OR (US) 97133

( * ) Notice: Subject to any disclaimer, the term of this patent is extended or adjusted under 35 U.S.C. 154(b) by 0 days.

(21) Appl. No.: 12/286,400

(22) Filed: Sep. 30, 2008

Related U.S. Application Data

(62) Division of application No. 11/504,955, filed on Aug. 16, 2006, now Pat. No. 7,497,057.

(51) Int. Cl.
*E04H 1/00* (2006.01)
*E04B 2/00* (2006.01)
*E04C 3/00* (2006.01)

(52) U.S. Cl. ..... 52/576; 52/235; 52/506.05

(58) Field of Classification Search ..... 52/578, 52/309.1, 204.597, 506.5, 184–186, 235, 52/79.6, 106
See application file for complete search history.

(56) References Cited

U.S. PATENT DOCUMENTS 3,251,168 A * 5/1966 Waring et al. ..... 52/460
3,358,969 A * 12/1967 Horgan, Jr. et al. ..... 256/24
3,715,848 A * 2/1973 Jordan ..... 52/235
4,956,954 A * 9/1990 Horgan, Jr. ..... 52/204.53
5,771,646 A * 6/1998 DeSouza ..... 52/263
5,967,498 A * 10/1999 Junell ..... 256/19
6,269,600 B1 * 8/2001 Tambakakis ..... 52/235
6,517,056 B2 * 2/2003 Shepherd ..... 256/24
6,647,562 B1 * 11/2003 Arout et al. ..... 4/506
6,804,920 B2 * 10/2004 Hogan ..... 52/235
6,964,410 B1 * 11/2005 Hansen ..... 256/24
7,032,891 B2 * 4/2006 Rowley et al. ..... 256/26
7,127,865 B2 * 10/2006 Douglas ..... 52/745.13
7,434,790 B1 * 10/2008 Hansen ..... 256/24
7,530,549 B1 * 5/2009 Hansen et al. ..... 256/60
7,559,536 B1 * 7/2009 Hansen et al. ..... 256/25

* cited by examiner

*Primary Examiner*—Richard E Chilcot, Jr.
*Assistant Examiner*—Mark R Wendell
(74) *Attorney, Agent, or Firm*—Michael Tavella

(57) ABSTRACT

An improved railing/wall system for elevated slab balconies. The system uses a number of fascia brackets to secure posts to the outer face of the elevated slab balcony. The posts have a base track secured to them. Infill panels are then placed between the posts to provide the wall structure. A top rail can be used to cover the top of the infill panels. The lower portion of the infill panels also can be tinted to conceal the face of the concrete balcony, if desired. The infill panels can be selected from a group of materials, including tempered glass, pickets, expanded metal, perforated metal, metal cut with water jets or a composite material.

9 Claims, 7 Drawing Sheets

FASCIA-MOUNTED ALUMINUM RAILING SYSTEM

CROSS REFERENCE TO RELATED APPLICATIONS

This application is a division of application Ser. No. 11/504,955 filed Aug. 16, 2006 now U.S. Pat. No. 7,497,057.

STATEMENT REGARDING FEDERALLY SPONSORED RESEARCH AND DEVELOPMENT

Not Applicable

BACKGROUND OF THE INVENTION

1. Field of the Invention

This invention relates to aluminum railing systems and particularly to aluminum railing systems mounted to the face of an elevated concrete balcony slab.

2. Description of the Prior Art

Modern building design for high-rise apartments and other types of building structures often have concrete balconies. These balconies allow the residents to enjoy outdoor space attached to their dwelling units or offices. For safety purposes, these balconies have railing systems installed. Typically, these guardrails are fabricated from metal or concrete. Guardrails fabricated using metal are usually either surface mounted to the top of the slab using a base plate, or mounted into a core pocket. Although these designs work and provide the necessary protection, they are not the most aesthetically pleasing constructions.

BRIEF DESCRIPTION OF THE INVENTION

The instant invention provides an improved railing/wall system for elevated slab balconies. It is a fascia-mounted aluminum railing system (FMARS). The FMARS system uses a number of fascia brackets to secure posts to the outer face of the elevated slab balcony. The posts have a base track secured to them. A number of infill panels are then placed between the posts to provide the railing structure. The infill panels can be tempered glass, pickets, or other infill materials. When glass panels are used, the lower portion of the glass panels also can be tinted or coated to conceal the face of the concrete slab to create a unique aesthetic quality.

DETAILED DESCRIPTION OF THE INVENTION

Figure 1:
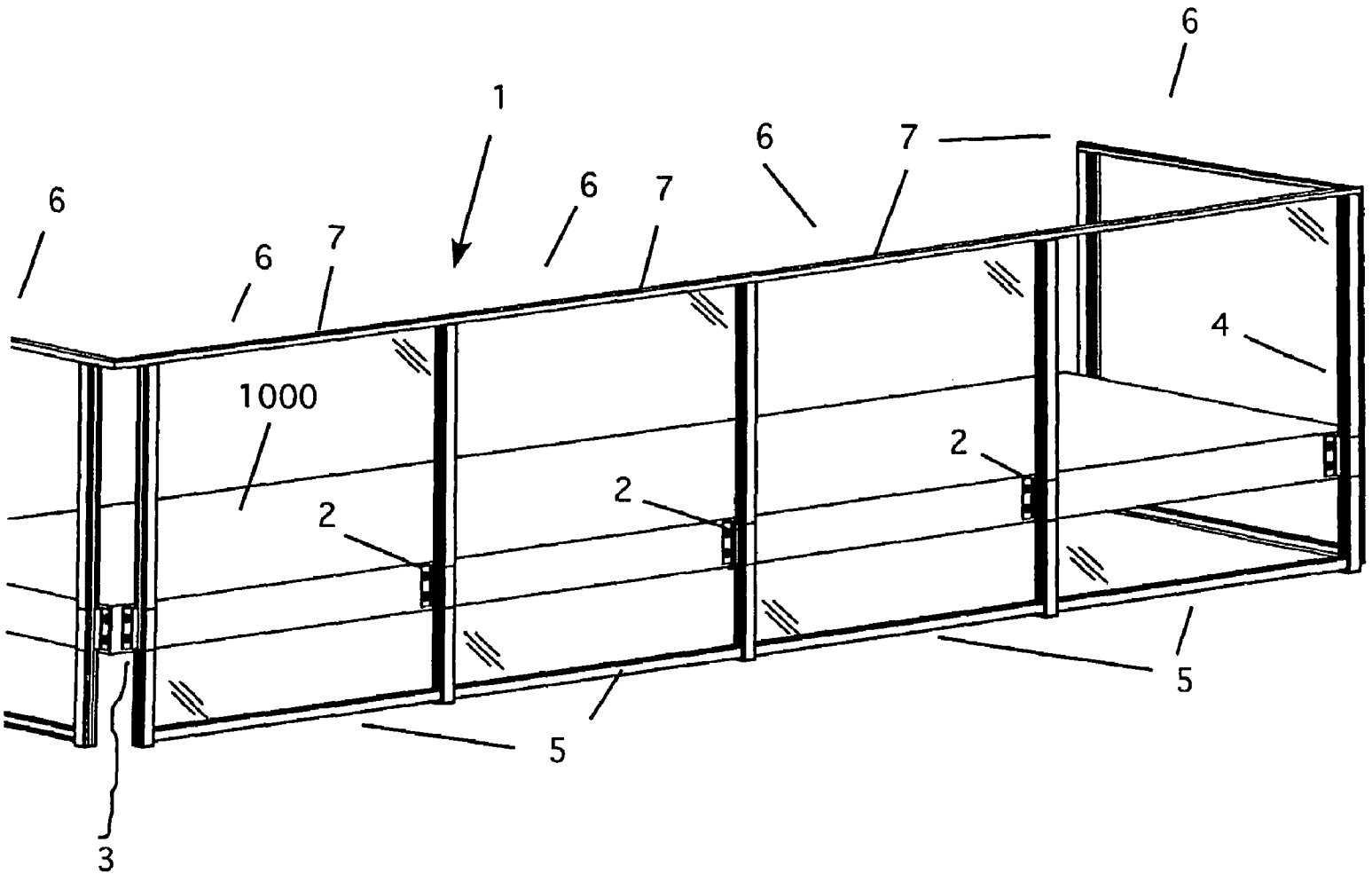
FIG. 1 is a perspective view of the fascia-mounted aluminum railing system.

Referring now to FIG. 1, a perspective view of the FMARS 1 is shown. As mentioned above, this system is applied to an elevated slab 1000. Typically, these slabs are reinforced concrete, however, the system can be utilized on other balcony materials, such as wood and steel.

The key to this system is a series of fascia brackets 2 for straight runs and a special corner bracket 3 for the corners. The fascia brackets support a number of vertical posts 4 that are secured to the fascia brackets using splices (see below). In an alternative embodiment, the post can be one piece and are passed through the brackets and secured. This embodiment is discussed below. A bottom rail 5 is secured to the posts as shown. The posts and bottom rail form a frame in which infill panels 6 are placed. The infill options include tempered glass panels, pickets, and panels made of other materials such as expanded or perforated metals, composite materials or water jet panels (which are metal panels cut with a water jet to give a decorative appearance.) This construction is discussed in detail below. The panels are typically kept at the height of the posts and the system can be fitted with a top rail 7. Of course, variations in this design are also possible.

Figure 2:
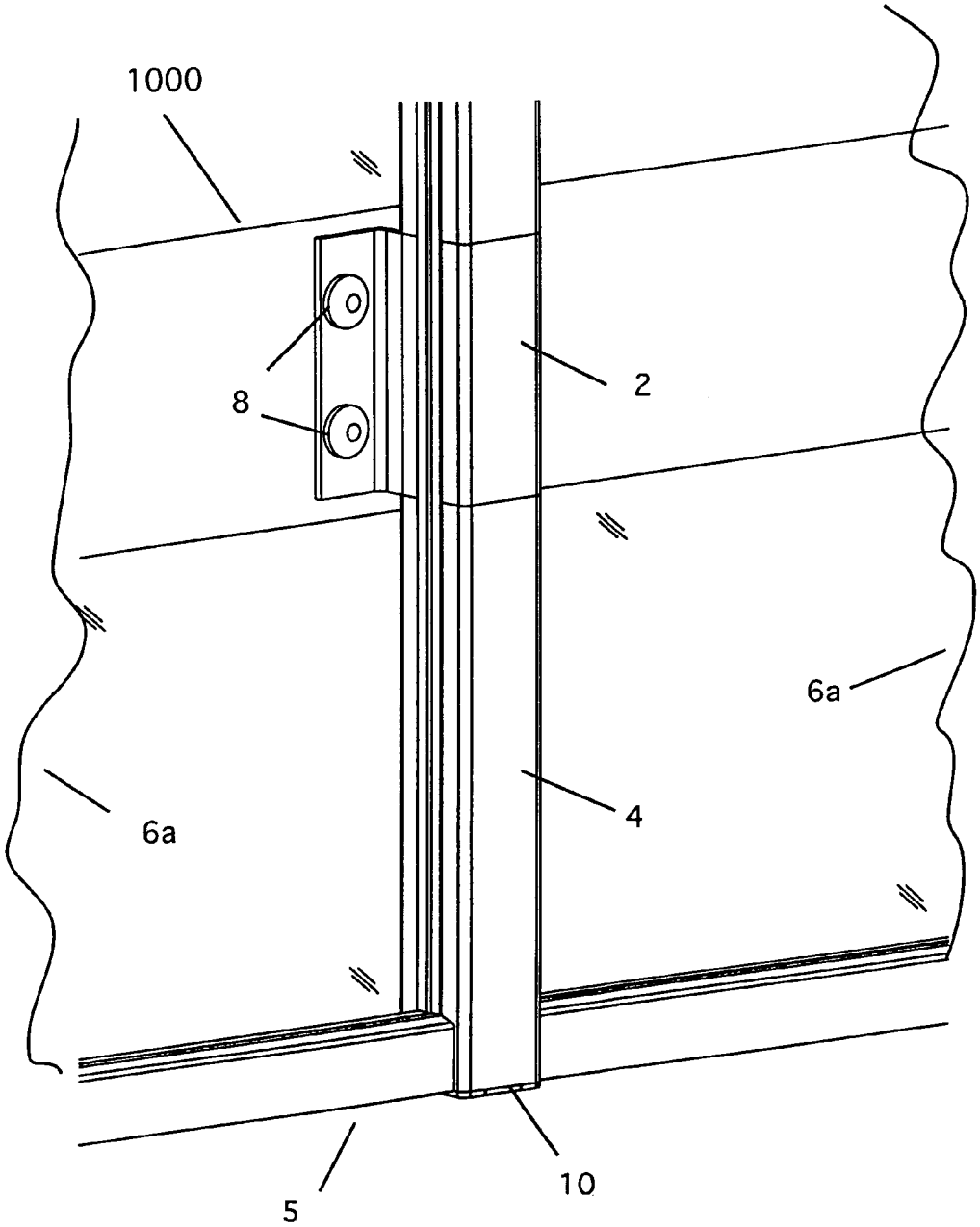
FIG. 2 is a detail view of the fascia bracket, vertical post and bottom rail portions of the system.
Figure 5:
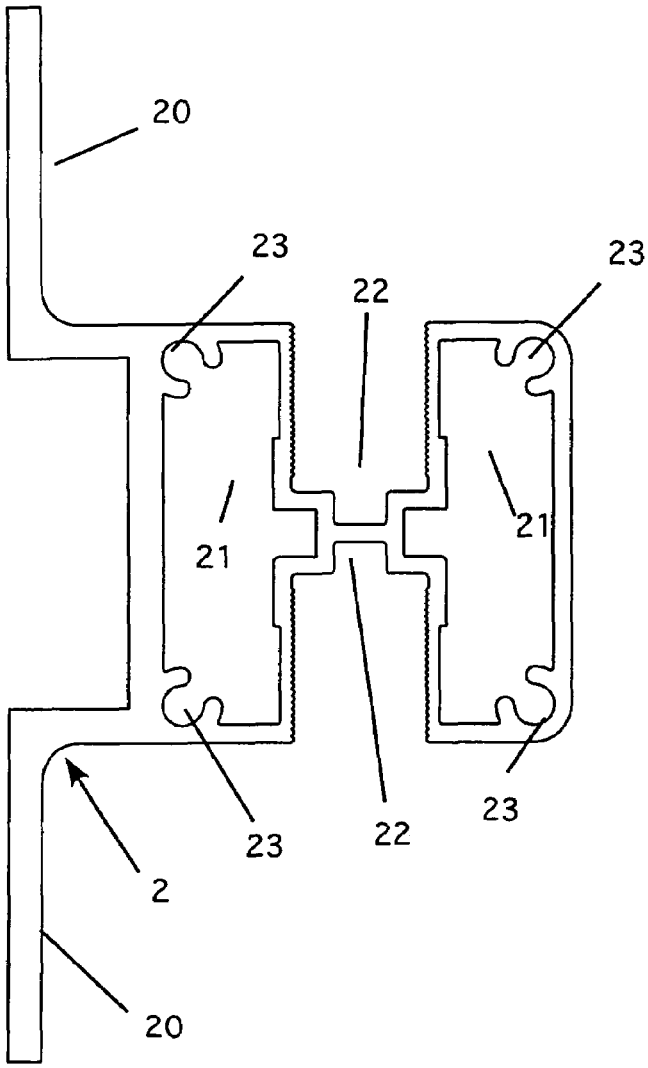
FIG. 5 is a cross-section of a fascia bracket extrusion.

FIG. 2 is a detail view of the fascia bracket and bottom rail portions of the system. In this embodiment, the fascia bracket is secured to the slab 1000 using conventional fasteners 8 suitable for the purpose. The shape of the fascia bracket is shown in FIG. 5. It is designed to accommodate the vertical post sections as well as the infill panel. The vertical post 4 is actually made of two pieces. These are assembled using a splice, as discussed below. Sections of bottom rail 5 are attached to the posts. These provide a base for the infill panels 6 to sit. The infill panels are held in the posts using techniques common to the art. A bottom cap 10 is secured to the bottom of the lower post section to enclose the post and give the design a finished look.

Where glass panels are used, the preferred embodiment, the infill panels are made of ¼-inch or ⅜-inch-tempered glass. As an option, the lower portion of the panel, area 6*a* can be tinted or coated to hide the slab edge.

Figure 3:
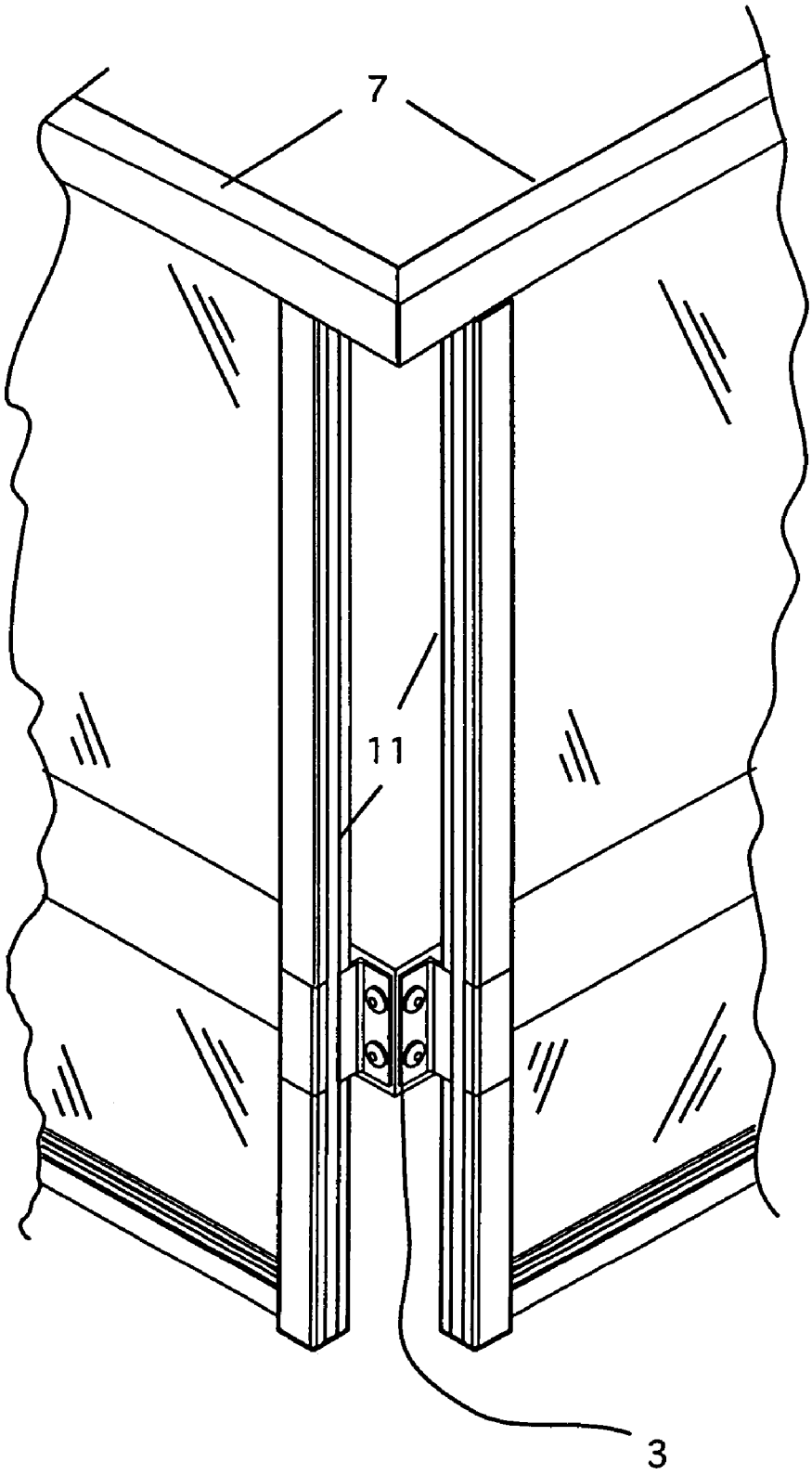
FIG. 3 is a detail view of a corner application.

FIG. 3 is a detail view of a corner assembly. At the corners, a special fascia bracket 3 is used. These brackets have the same basic configuration as the regular fascia brackets. However, they are designed to accept a snap-in channel cover 11 to cover the open ends of the corner posts and brackets. Note that this figure also shows the top covers 12. The top covers for the center posts have double indent to accommodate infill panels on both sides.

This figure also shows a top rail 7. Note also that the top rail 7 is joined by a miter joint at the corners, although this can vary depending on the desired design appearance.

Figure 4:
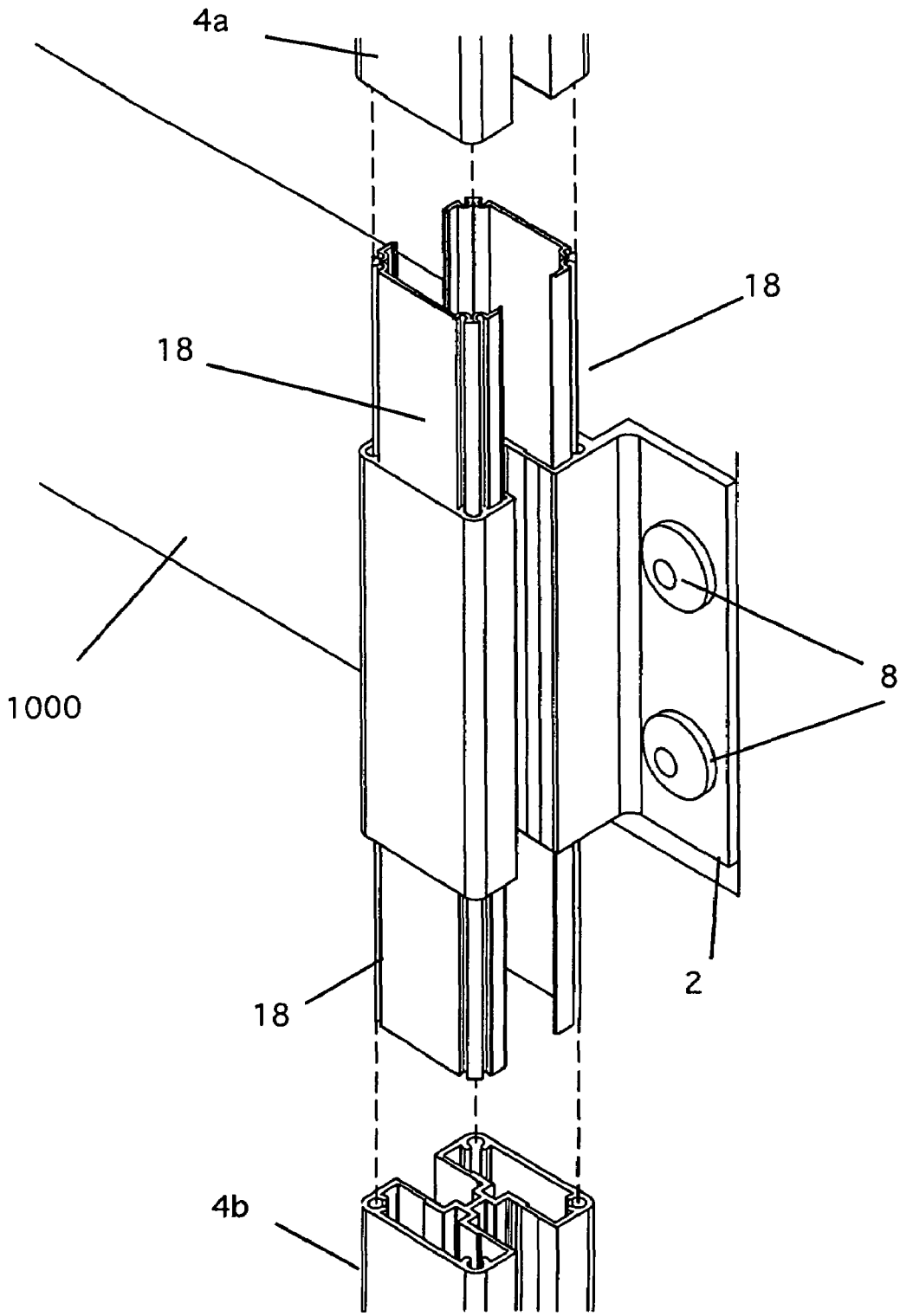
FIG. 4 is a detail view of the post-fascia bracket assembly.

FIG. 4 is a detail view of the post-fascia bracket assembly for the first embodiment. Here, the fascia bracket 2 is attached to the slab 1000 as discussed above. Because of the construction of the fascia bracket (see FIG. 5), the posts cannot pass into the fascia brackets 2. Thus, to form the post and fascia assembly, the vertical post must be made of two pieces. FIG. 4 shows the upper portion 4*a* of the post and the lower portion 4*b* of the post aligned with the fascia bracket 2. Moreover, because the post portions cannot pass into the fascia brackets 2, additional supports must be provided to hold the posts in place on top of and under the fascia bracket 2. This is accomplished using two splice extrusion members 18. The splice extrusion members 18 pass through the fascia brackets as shown. They are secured using epoxy and, if necessary, appropriate fasteners. As shown in FIG. 4, the splice extrusion members 18 align with the extruded forms of the posts 4*a* and 4*b*. The post portions slide over the splice extrusion members until the post portions butt up against the fascia brackets. The post portions are then secured using epoxy and, if needed, appropriate fasteners.

FIG. 5 is a cross-section of a fascia bracket extrusion for the first embodiment. The fascia brackets 2 have a pair of mounting flanges 20 that extends outward from the main body of the brackets. The main body has two open channels 21 that hold the splice extrusion members, as discussed above. A center web 22 joins the two channels 21 and provides a pair of channels for the infill panels. Note that the two open channels 21 have corner recesses 23 formed in them. These recesses receive the flanges on the splice extrusion members, as discussed below.

Figure 6:
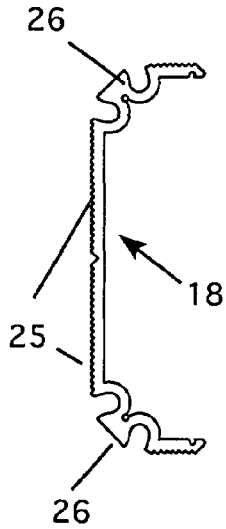
FIG. 6 is a cross-section of a splice extrusion member.

FIG. 6 is a cross-section of a splice extrusion member 18 used in the first embodiment. The splice extrusion members had a shape that conforms to the shape of the open channels 21 of the fascia brackets. Note that the outer surfaces of the splice extrusion members have edges formed with gripping teeth 25 to help hold the splice extrusion members in the fascia brackets firmly in place. The splice extrusion members 18 also have corner flanges 26 that fit into the recesses 23 formed in the fascia brackets.

Figure 7:
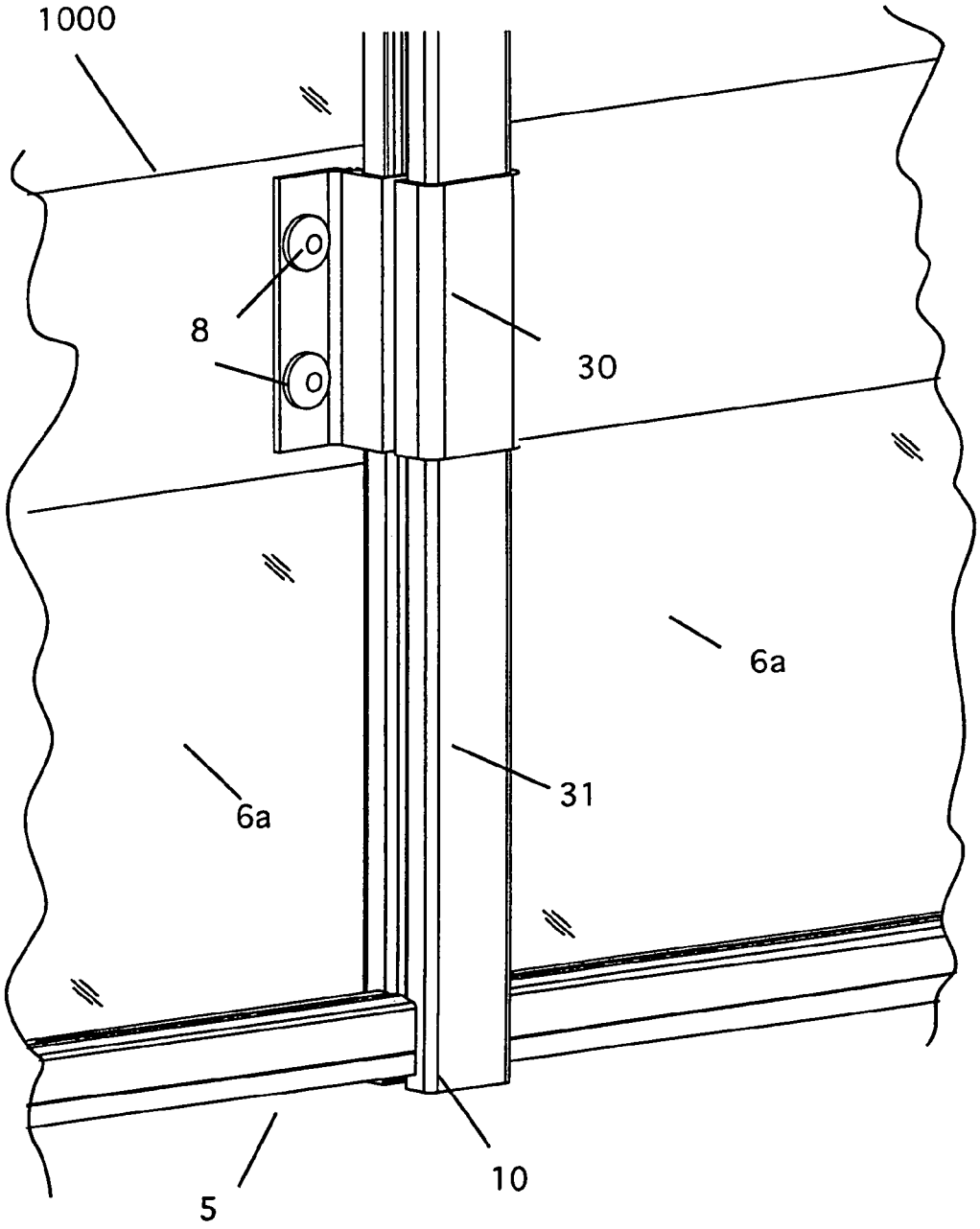
FIG. 7 is a detail view of the second embodiment of the fascia bracket, vertical post and bottom rail portions of the system.

FIG. 7 is a detail view of the second embodiment of the fascia bracket, vertical post and bottom rail portions of the system. In this embodiment, no splices are used. Instead, a one-piece vertical post is slid down into the bracket until the desired position is reached. The post is then secured to the bracket using suitable fasteners in a mechanical connection. Although this embodiment is not as clean in appearance as the first embodiment, it is much simpler than the first embodiment and provides flexibility for field conditions. In the figure, the new bracket 30 is shown with the single-piece post 31 passing through it. The bracket has side channels as before to hold the infill panels and bottom rail 5.

Figure 8:
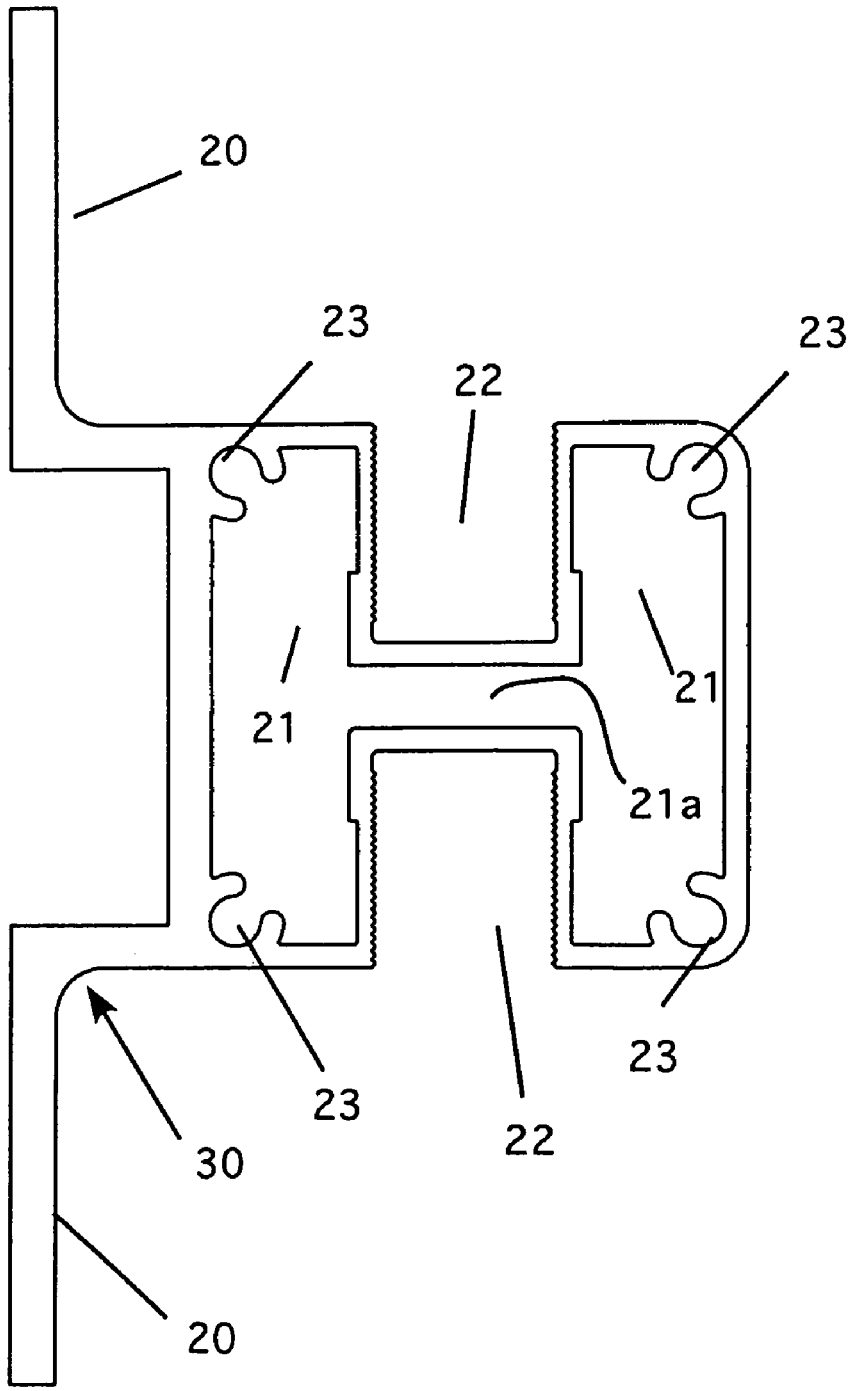
FIG. 8 is a cross-section of a fascia bracket extrusion for the second embodiment of the fascia bracket.

FIG. 8 is a cross-section of a fascia bracket extrusion for the second embodiment of the fascia bracket. This embodiment of fascia bracket 30 has a pair of mounting flanges 20 that extends outward from the main body of the brackets, as before. The main body has two open channels 21 and a center channel 21*a* that one-piece post 31 (not shown). A center channel 21*a* joins the two channels 21 to form a pair of channels 22 for the infill panels. Note that the two open channels 21 have corner recesses 23 formed in them. These recesses receive flanges on the post members, which are similar to those formed on the splice members, as discussed above. To set the post, the post is slid into the bracket until the flanges line up with the recesses 23 in the brackets. At this point, the post is set and can be secured in place.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A fascia-mounted aluminum railing system for mounting on an elevated slab having a face perimeter, comprising:

a) a plurality of fascia brackets secured to the face perimeter at spaced-apart intervals, each of said plurality of fascia brackets including:

i) a means for securing said fascia bracket to said elevated slab, and ii) an extrusion having a center portion having two open channels therein separated by a center web, said extrusion further including pair of channels being oppositely disposed on an outer surface of said extrusion;

b) a plurality of vertical posts, secured to the plurality of fascia brackets and extending upward and downward therefrom, thereby forming a lower post portion and an upper post portion;

c) a plurality of bottom rail sections, secured to the lower post portions and extending therebetween; and d) a plurality of infill panels, secured in said plurality of said vertical posts such that said plurality of infill panels fit into said channels on the outer surface of said extrusions and rest on said plurality of bottom rail sections.

2. The fascia-mounted aluminum railing system of claim 1 further comprising a top rail, installed on said plurality of infill panels and extending between said plurality of vertical posts.

3. The fascia-mounted aluminum railing system of claim 1 wherein the plurality of infill panels is made of tempered glass.

4. The fascia-mounted aluminum railing system of claim 3 wherein the portion of said plurality of infill panels extending downward along said lower post portions is tinted.

5. The fascia-mounted aluminum railing system of claim 1 wherein each of said plurality of fascia brackets further comprises a first splice member extending downward from the fascia bracket and a second splice member extending upward from said fascia bracket.

6. The fascia-mounted aluminum railing system of claim 5 further comprising a means for securing each lower post portion of said plurality of vertical posts to said first splice member and a means for securing each upper post portion of said plurality of vertical posts to the second splice member.

7. The fascia-mounted aluminum railing system of claim 6 wherein the means for securing includes an epoxy adhesive.

8. The fascia-mounted aluminum railing system of claim 1 wherein one of said plurality of vertical posts are placed with in one of said plurality of fascia brackets such that the lower portion of said vertical posts extends below said fascia bracket and the upper portion of said vertical post extends upward from said fascia bracket.

9. The fascia-mounted aluminum railing system of claim 8 wherein each of said plurality of vertical posts is secured to each of said plurality of fascia brackets by mechanical fasteners.

* * * * *